US005199767A

United States Patent [19]

Jimbo

[11] Patent Number: 5,199,767

[45] Date of Patent: Apr. 6, 1993

[54] METHOD OF LIFTING DEEPSEA MINERAL RESOURCES WITH HEAVY MEDIA

[76] Inventor: Kenjiro Jimbo, 34-11-301, Satsukigaoka 2-chome, Chiba-shi, Chiba 281, Japan

[21] Appl. No.: 651,251

[22] PCT Filed: Jan. 17, 1990

[86] PCT No.: PCT/JP90/00050

§ 371 Date: Mar. 12, 1991

§ 102(e) Date: Mar. 12, 1991

[87] PCT Pub. No.: WO91/10808

PCT Pub. Date: Jul. 25, 1991

[51] Int. Cl.[5] ..... E21C 45/00

[52] U.S. Cl. ..... 299/8; 37/320; 37/314; 406/109; 406/197

[58] Field of Search ..... 299/8, 9; 37/58, 59, 37/DIG. 8; 406/53, 56, 106, 109, 120, 146, 197

[56] References Cited

U.S. PATENT DOCUMENTS

| | | | |
|---|---|---|---|
| 2,937,049 | 5/1960 | Osawa | 37/59 X |
| 3,753,303 | 8/1973 | Holzenberger et al. | 37/58 |
| 4,391,468 | 9/1979 | Funk | 299/8 |
| 4,878,711 | 11/1989 | Vinot et al. | 299/9 |

FOREIGN PATENT DOCUMENTS

| | | | |
|---|---|---|---|
| 3035904 | 4/1982 | Fed. Rep. of Germany | 299/9 |
| 56-40238 | 9/1981 | Japan . | |
| 609200 | 3/1985 | Japan . | |

*Primary Examiner*—David J. Bagnell

*Attorney, Agent, or Firm*—Wenderoth, Lind & Ponack

[57] ABSTRACT

Heavy media, which are heavier than the bulk density of nodules of raw deepsea mineral resources, are used to discharge the nodules on a marine ship through a lifting pipe from a sea floor U-tube connecting with a downstream pipe laid to the deepsea bottom, by operating a piston pump on the marine ship. The heavy media are fed through the downstream pipe, and when nodules mined at the deepsea floor, mainly manganese nodules and cobalt-rich crusts which contain useful heavy metal, are fed into the sea floor U-tube through feeding devices, the nodules are continuously lifted with the heavy media through the lifting pipe from the sea floor to the marine ship, by buoyant force yielding from the heavy medium. This method requires much smaller power consumption than any conventional method of lifting nodules.

3 Claims, 2 Drawing Sheets

METHOD OF LIFTING DEEPSEA MINERAL RESOURCES WITH HEAVY MEDIA

TECHNICAL FIELD

This invention relates to a method of lifting raw deepsea mineral resources, mainly manganese nodules and cobalt-rich crusts mined at the deepsea floor, with heavy media through a lifting pipe from the sea floor to the sea surface, by buoyant force yielding from the heavy medium which has a density heavier than the bulk density of the raw deepsea mineral resources.

BACKGROUND ART

The prior art of lifting raw deepsea mineral resources mined at the deepsea floor from the sea floor to the sea surface involves two basic methods: Continuous Line Bucket (CLB) and hydraulic lifts.

CLB is a method of mining and lifting raw cobalt-rich crusts distributed on the sea floor at a water depth of 800~2,400 m with many buckets which are attached to a long loop of rope in regular intervals. If the water depth is deeper than 2,400 m, this method will be difficult, and besides it has disadvantages such as small lifting capacity.

Hydraulic lifts are methods of lifting raw manganese nodules concentrated widely in the Clarion-Clipperton zone of the northeastern Pacific Ocean at a water depth of 4,000~6,000 m using hydraulic power through lifting pipes to the sea surface. These are still classified into three methods as follows.

The first is an air-lift method of lifting raw manganese nodules to the sea surface by flowing high compressed air in the lifting pipe through air-lift jet units situated at a water depth about 2,000 m from air compressors on a marine ship. This method has the advantage of easy maintenance of air compressors situated on the marine ship, but on the other hand it has the disadvantage of large power consumption by them.

The second method is a centrifugal pump lifting method of lifting raw manganese nodules to the sea surface by operating high head/multiple-stage/centrifugal submersible pumps situated in the lifting pipe. This method makes it difficult to maintain centrifugal pumps which are situated at a water depth of at least 1,000 m, and has the advantage of smaller power consumption than the above air-lift method, but it also has the disadvantage of large power consumption.

The third method is a high density slurry pumping and lifting method of lifting a highly dense slurry mixed with sea water through the lifting pipe to the sea surface, the slurry being produced from raw manganese nodules ground by a crusher situated on the deepsea floor and fed into a piston pump also situated there. The advantage of this method is that the lifting pipe diameter can be smaller than those of the above air-lift and centrifugal pump lifting methods when lifting volumes are the same, but this method will require new development of reliable sea floor units (crusher, piston pump) and has the disadvantage of large power consumption.

SUMMARY OF INVENTION

An object of this invention is to provide a method of continually lifting raw deepsea mineral resources, mainly manganese nodules and cobalt-rich crusts, which contain useful heavy metal, mined at the deepsea floor, with heavy media through a lifting pipe from the sea floor to the sea surface, by buoyant force yielding from the heavy medium which has a density heavier than the bulk density of the raw deepsea mineral resources. As a result, the invention may continually lift raw deepsea mineral resources by much smaller power consumption than any other prior method of lifting raw mineral resources mentioned above.

DETAILED DESCRIPTION OF INVENTION

Figure 1:
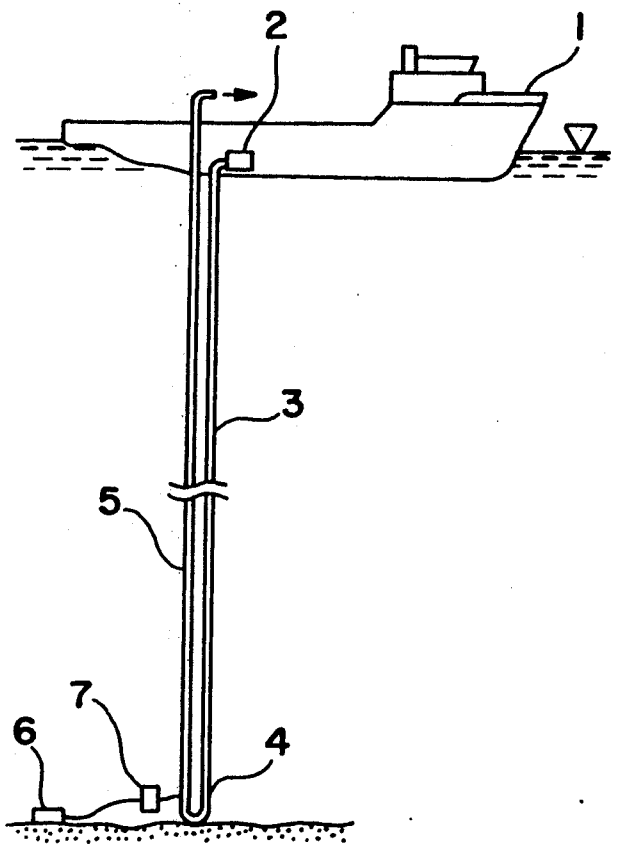
FIG. 1 is a conceptual illustration of a method of lifting nodules with heavy media embodying the present invention.

FIG. 1 shows the concept of the method of lifting raw deepsea mineral resources which is the object of this invention. Heavy media (including heavy suspensions) having adjusted density, which may lift raw deepsea mineral resources (described as nodules hereinafter) by buoyant force yielding from the heavy medium, are supplied by operating a piston pump 2 situated on a marine ship 1 to a sea floor U-tube 4 connecting with a downstream pipe 3 laid to the deepsea bottom, and are discharged on the marine ship 1 through a lifting pipe 5.

On the other side, after nodules mined by a miner (or collector) 6 at the deepsea bottom are fed into the sea floor U-tube 4 through a feeding device 7, the nodules are lifted with the heavy medium by buoyant force yielding from the heavy medium, through the lifting pipe 5 and are discharged on the marine ship 1. In this case, the power of the piston pump 2 is only consumed to overcome the total heavy media loss of head inside the above pipes 3, 4, 5 and the feeding device 7, and the pressure head difference of heavy media between the outlet of the lifting pipe 5 and the inlet of the downstream pipe 3. Pump power to lift nodules from the sea bottom to the sea surface is unnecessary because the nodules are lifted by buoyant force yielding from the heavy media.

Figure 2:
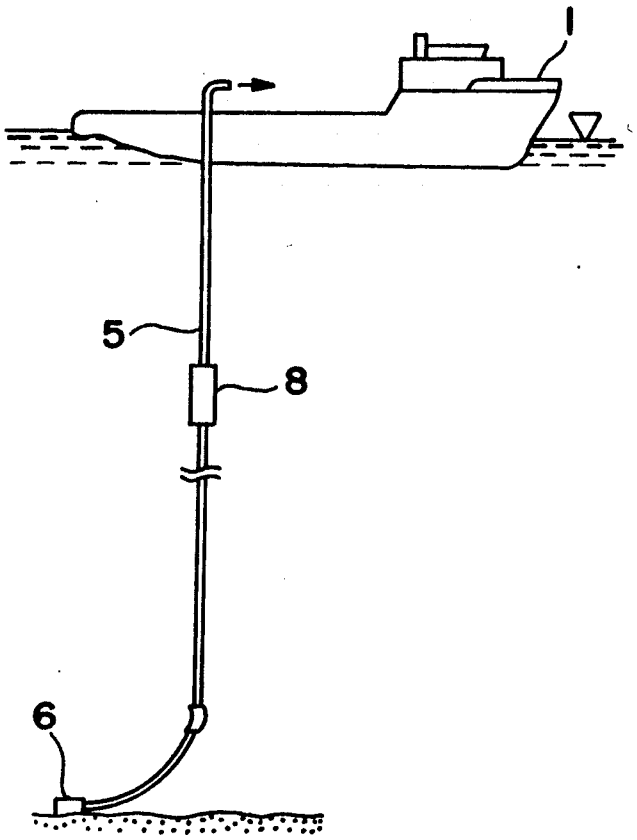
FIG. 2 PRIOR ART
FIG. 2 shows a conceptual illustration of a method of centrifugal pump lifting which is a traditional technique, to compare it with the above method of lifting nodules with heavy media.

FIG. 2 shows the concept of a method of centrifugal pump lifting, and this method is selected as typical of prior hydraulic lift methods which are mentioned above, to compare with the method of lifting with heavy media of this invention. Nodules mined by a miner 6 at the deepsea bottom are fed by a centrifugal pump 8 and are discharged on a marine ship 1 through a lifting pipe 5 with sea water by hydraulic transportation. In this case, power of the centrifugal pump 8, which is necessary for lifting nodules from the deepsea bottom to the marine ship 1, is consumed to overcome the pipeline loss of head of the lifting pipe 5 and water head of the water depth and to lift nodules from the deepsea to the sea surface. The method of centrifugal pump lifting has the disadvantage of much larger power consumption that the method of lifting nodules with heavy media by means of the present invention in FIG. 1.

BEST MODE FOR CARRYING OUT THE INVENTION

Figure 3:
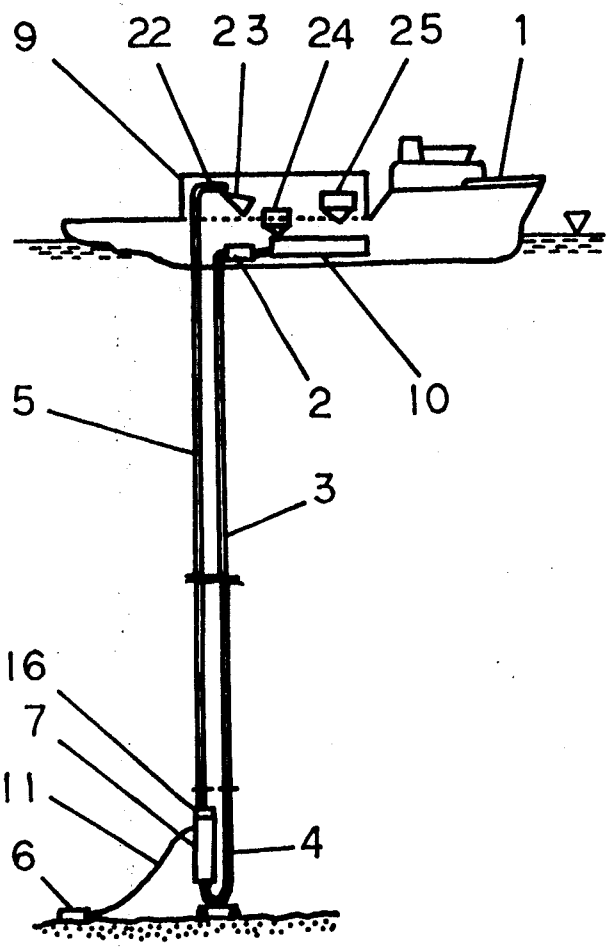
FIG. 3 is a detailed view of FIG. 1 and includes equipment in a preparation plant on a marine ship and feeding devices at the deepsea bottom.

Details of the invention will be explained with reference to the attached drawings. Referring to FIG. 3, heavy media (including heavy suspensions) are made by blending with heavy medium materials such as barite and ferrosilicon, which are used widely in heavy medium separation, additives and sea water in a heavy medium regulative cell 10 on a marine ship 1. A density of the heavy media is selected which is heavier than the bulk density of the nodules, and which is assumed to be about in the range of 1.04~3.87. The above heavy media are discharged through a downstream pipe 3 and a sea floor U-tube 4 and a lifting pipe 5 by operating a piston pump 2 which is situated on the marine ship 1. Nodules are mined by a miner (or collector) 6 at the deepsea bottom and are crushed into a particle size floatable with heavy media through the lifting pipe 5, and are fed into a feeding device 7 with sea water through a flowing pipe 11.

Figure 4:
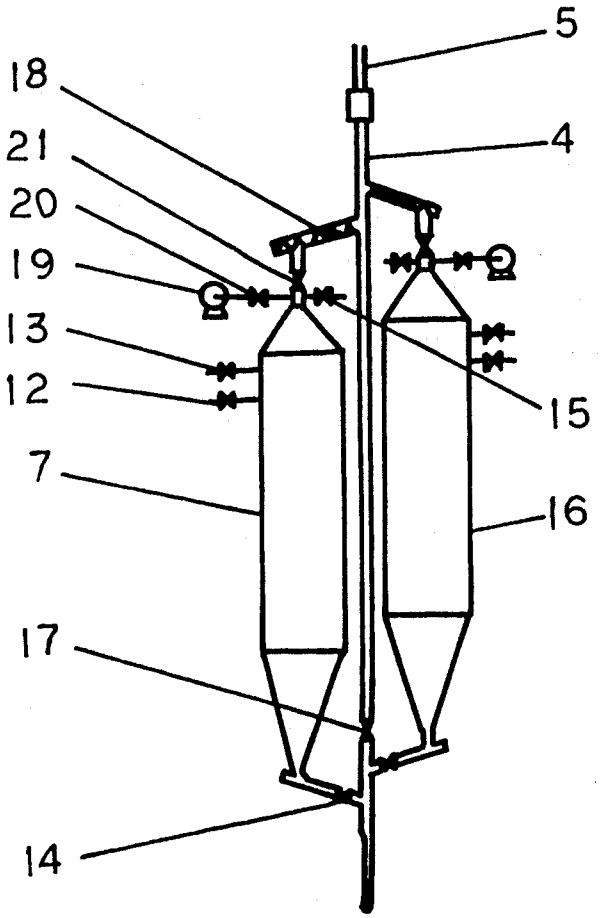
FIG. 4 is a side view of FIG. 3 showing an enlarged view of the feeding devices.

Referring to FIG. 4, nodules are fed with sea water in the direction of a tangent at the upper cylindrical part of the feeding device 7, when a feeding valve 12 situated outside of the feeding device 7 is opened, and fine sea floor sediment contained in the nodules and overflowing sea water are discharged through a discharge valve 13. The feed valve 12 and the discharge valve 13 are shut, when the feeding device 7 is filled up with nodules. A sea water valve 15 and a lower valve 14 are opened, when a squeeze valve 17 arranged in sea floor U-tube 4 is squeezed, and when heavy media are supplied from the lower part of the feeding device 7 through the lower valve 14, sea water in the feeding device 7 moves from the lower part to the upper part and is discharged from the sea water valve 15, and an upper valve 21 is opened when the sea water valve 15 is shut, and heavy media pressure in the feeding device 7 and the sea floor U-tube 4 is balanced. When nodules, which are floated at the upper part of the feeding device 7, are fed into the sea floor U-tube 4 by operating an upper screw conveyor 18, and the operation of the above upper screw conveyor 18 is stopped, the upper valve 21 is shut and the squeeze valve 17 is fully opened. When a sea water pump 19 situated on the upper outside of the feeding device 7 is opened, a sea water inflow valve 20 is opened and sea water is supplied from the upper part of the feeding device 7, and heavy media in the feeding device 7 move at the lower part and are supplied in the sea floor U-tube 4 through the lower valve 14, and the lower valve 14 and the sea water inflow valve 20 are shut, and the operation of sea water pump 19 is stopped and the feeding device 7 is filled up with sea water. Also referring to FIG. 4, another feeding device 16 of the same type as the feeding device 7, which is situated in parallel with the feeding device 7, is operated and nodules may be continuously fed in the sea floor U-tube 4.

As the result of the above, nodules, which are fed in the sea floor U-tube 4 from the feeding device 7, 16 by repeating alternately the same operation as mentioned above, are floated up the inside of the lifting pipe 5 through the sea floor U-tube 4 with heavy media by buoyant force yielding from the heavy medium and are continually lifted and are discharged with heavy media at an outlet 22 of lifting pipe 5.

Nodules, which are discharged with heavy media, are separated from heavy media by means of a heavy medium separator 23 in a preparation plant 9.

After heavy media, which are separated from nodules and recovered by a heavy medium concentrator 24, are adjusted for density and also for reuse, the heavy media are blended with other media in the heavy medium regulative cell 10. Nodules, which are separated from heavy media by means of the above heavy medium separator 23, are recovered as nodule concentrates by operating a medium recovery unit 25 in the preparation plant 9, if necessary.

INDUSTRIAL APPLICABILITY

As mentioned above, the method of lifting deepsea mineral resources according to this invention may continually lift much raw deepsea mineral resources, mainly manganese nodules and cobalt-rich crusts which are concentrated widely on the worldwide deepsea floor and contain valuable heavy metal such as manganese, cobalt, nickel, etc., from the sea floor to the sea surface. Since the invention lifts raw deepsea mineral resources with heavy media by buoyant force yielding from the heavy medium, which has a density heavier than the bulk density of the mineral resources, the method has a large advantage of much smaller power consumption than any conventional method of lifting raw deepsea mineral resources.

I claim:

1. A method of lifting raw deepsea mineral resources mined at a deepsea floor with a heavy medium through a lifting pipe from the sea floor to the sea surface, by buoyant force exerted by said heavy medium, which has a density heavier than a bulk density of said mineral resources, which method comprises (1) blending heavy medium materials, additives and sea water in a regulative cell to produce said heavy medium, (2) pumping said heavy medium from the sea surface sequentially through a downstream pipe, a sea floor U-tube and a lifting pipe by operating a piston pump, (3) feeding nodules of said mineral resources into said tube by operating a first feeding device, (4) operating a second feeding device which is situated in parallel with said first feeding device for continuously feeding said nodules into said U-tube, (5) alternately operating said first and second feeding devices to continuously lift said nodules up the inside of said lifting pipe with said heavy medium by said buoyant force exerted by said heavy medium, and (6) discharging said nodules with said heavy medium from said lifting pipe onto a marine ship on the sea surface.

2. The method according to claim 1, which further comprises crushing said nodules, mined by a miner, into a particle size floatable with said heavy medium through said lifting pipe, feeding the crushed nodules with sea water in a direction tangent to an upper cylindrical part of said first feeding device through a flowing pipe when a feed valve for said first feeding device is opened, discharging fine sea floor sediment contained in said nodules and overflowing sea water through a discharge valve of said first feeding device, when said first feeding device is filled with nodules shutting said feed valve and discharge valve, opening a sea water valve and a lower valve and squeezing a squeeze valve, when said heavy medium is supplied from the lower part of said first feeding device through said lower valve, moving sea water in said first feeding device from the lower part to the upper part of said first feeding device and discharging said sea water from said sea water valve, opening an upper valve when said sea water valve is shut, and balancing pressure of said heavy medium in said first feeding device and said U-tube, feeding nodules, which are floated at the upper part of said first feeding device, into said U-tube by operating an upper screw conveyor, stopping the operation of said upper screw conveyor, shutting said upper valve, and opening fully said squeeze valve, opening a sea water inflow valve and operating a sea water pump to supply sea water from the upper part of said first feeding device, moving said heavy medium in the lower part of said first feeding device into said U-tube through said lower valve, shutting said lower valve and sea water inflow valve, stopping the operation of said sea water pump, and filling said first feeding device with sea water.

3. A feeding device for feeding nodules of deepsea mineral resources, which comprises a cylindrical member, lower valve means communicating with the lower part of said cylindrical member, upper valve means communicating with the upper part of said cylindrical member, sea water inflow valve means for introducing sea water into the upper part of said cylindrical member, sea water discharge valve means for discharging sea water from the upper part of said cylindrical member, feeding valve means for feeding the nodules into the upper part of said cylindrical member, and discharge valve means for discharging sea floor sediment from the upper part of said cylindrical member.

* * * * *